US005204580A

United States Patent [19]

Baba et al.

[11] Patent Number: 5,204,580

[45] Date of Patent: Apr. 20, 1993

[54] RING-SHAPED LAMP DEVICE HAVING BULB TILTABLE RELATIVE TO BASE STRUCTURE

[75] Inventors: Masaharu Baba; Takao Mizukami; Masako Nakamura, all of Yokohama, Japan

[73] Assignee: Toshiba Lighting & Technology Corporation, Tokyo, Japan

[21] Appl. No.: 729,853

[22] Filed: Jul. 12, 1991

Related U.S. Application Data

[63] Continuation of Ser. No. 409,786, Sep. 20, 1989, abandoned.

[30] Foreign Application Priority Data

Sep. 20, 1988 [JP] Japan ..... 63-235316
Sep. 22, 1988 [JP] Japan ..... 63-238001

[51] Int. Cl.[5] ..... H01J 5/54; H01J 61/52

[52] U.S. Cl. ..... 313/318; 313/15; 313/489; 439/229; 439/234; 439/238

[58] Field of Search ..... 313/15, 17, 19, 44, 313/46, 318, 493, 489, 634; 439/227, 229, 234, 238, 240, 612; 362/260, 269, 285, 287, 319, 372

[56] References Cited

U.S. PATENT DOCUMENTS

| | | | |
|---|---|---|---|
| 2,392,785 | 1/1946 | Thomas | 313/318 |
| 2,400,381 | 5/1946 | Young | 439/229 |
| 2,597,666 | 5/1952 | Oday et al. | 439/612 |
| 3,858,162 | 12/1974 | Mai et al. | 439/612 |
| 4,656,561 | 4/1987 | Shinbo et al. | 313/15 X |
| 4,931,685 | 6/1990 | Dobashi et al. | 313/489 X |

FOREIGN PATENT DOCUMENTS

| | | | |
|---|---|---|---|
| 48-114269 | 12/1973 | Japan . | |
| 165364 | 9/1984 | Japan | 313/489 |
| 63847 | 4/1985 | Japan | 313/318 |
| 61-54150 | 3/1986 | Japan . | |
| 639186 | 6/1950 | United Kingdom . | |

*Primary Examiner*—Donald J. Yusko
*Assistant Examiner*—Michael Horabik
*Attorney, Agent, or Firm*—Cushman, Darby & Cushman

[57] ABSTRACT

A lamp device includes a ring-shaped bulb, terminated at a prescribed annular length, each terminated portion of which is formed in a linear shape so as to make the bulb axis of one of the terminated portions coincide with that of the other terminated portion, and a base structure rotatably mounted around the opposite terminated portions of the bulb. Thus, the location of the bulb can be adjusted to a desirable position by the rotation of the bulb when the lamp device is attached to an external supporting device.

6 Claims, 4 Drawing Sheets

RING-SHAPED LAMP DEVICE HAVING BULB TILTABLE RELATIVE TO BASE STRUCTURE

This is a continuation of application Ser. No. 07/409,786, filed Sep. 20, 1989, which was abandoned upon the filing hereof.

BACKGROUND OF THE INVENTION

1. Field of the Invention

The invention relates, in general, to ring-shaped lamp devices. In particular, the invention relates to a ring-shaped fluorescent lamp device which is used for back lighting.

2. Description of the Related Art

Straight type cold cathode and hot cathode fluorescent lamps are used as back lighting for lighting meters of an automobile, e.g., the speedometer, etc.

In recent Years, a ring-shaped fluorescent lamp has been used, instead of a straight type fluorescent lamp. The ring-shaped fluorescent lamp will light a wide area compared with the straight type fluorescent lamp. One example of a conventional fluorescent lamp used as back lighting is disclosed in Japanese Laid open patent publication 61-54150, laid open to public inspection on Mar. 18, 1986. In this prior art, various shapes of fluorescent lamps, i.e., a ring-shape, a U-shape, a rectangular-shape, and a zigzag-shape, are disclosed therein. However, such lamps are not provided with a base. It is useful to provide a base to such lamps to connect the lamp with a power supply or to mount the lamp on an external supporting device. A conventional base structure is formed in a hollow and arc shape, and is provided with a plurality of connecting pins. Such a conventional base structure may be used with a ring-shaped fluorescent lamp for back lighting. However, the conventional base structure does not rotate around the axis of the bulb of the ring-shaped fluorescent lamp to provide a prescribed clearance. Therefore, it may be difficult to adjust the position of the bulb of the lamp against the external supporting device when mounting. It may also be difficult to correct the tilted position of the bulb after mounting the lamp device on the external supporting device.

SUMMARY OF THE INVENTION

Accordingly, it is an object of the invention to enable a ring-shaped lamp device to be adjusted against an external supporting device To accomplish the above-described object, the ring-shaped lamp device comprises a bulb including a tubular ring-shaped body portion having a defined annular length and a pair of tubular linear portions, a first end of each of which is connected to a corresponding end of the tubular ring-shaped body portion, a second end of each of which is sealed and faces one another at a prescribed distance apart. The ring-shaped lamp device also comprises a pair of electrodes, one of which is disposed in each of the tubular linear portions for producing discharge therebetween through the tubular ring-shaped body portion, and a base structure, including a connector, which is rotatably connected around the second ends of the tubular linear portions.

The ring-shaped lamp device may include a heat shrinkable tube which covers the bulb. The base structure may be attached to the second ends of the tubular linear portions through the heat shrinkable tube.

BRIEF DESCRIPTION OF THE DRAWINGS

These and other objects and advantages of this invention will become more apparant and more readily appreciated from the following detailed description of the presently preferred exemplary embodiments of the invention, taken in conjunction with the accompanying drawings wherein.

DETAILED DESCRIPTION OF THE PREFERRED EMBODIMENTS

Figure 1:
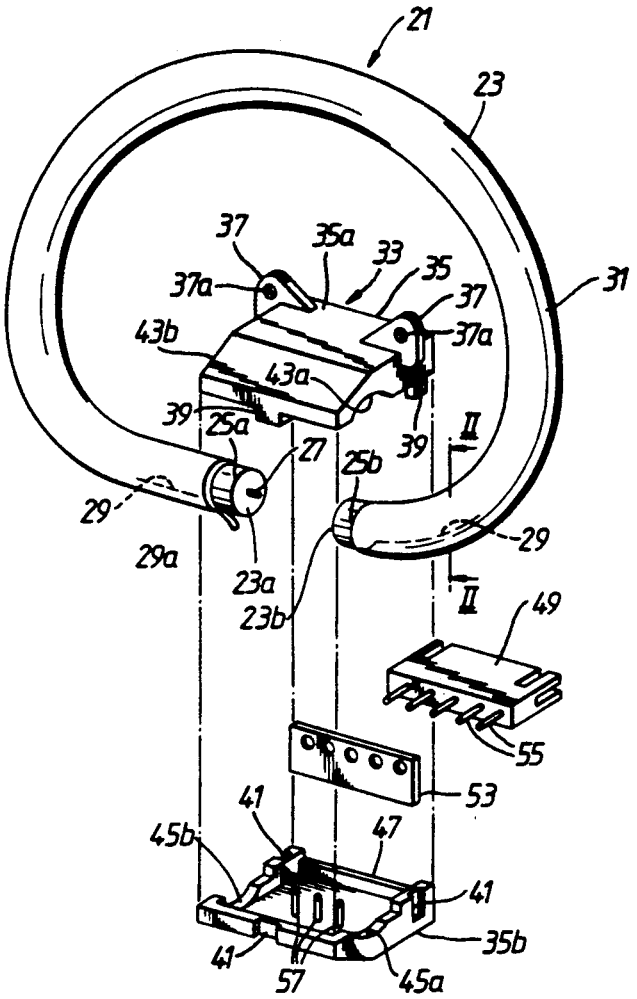
FIG. 1 is an exploded perspective view illustrating a ring-shaped lamp device of a first embodiment of the present invention.

Three preferred embodiments of the present invention will now be described in more detail with reference to the accompanying drawings. However, the same numerals are applied to the similar elements in the drawings, and therefore, the detailed descriptions thereof are not repeated.

Figure 2:
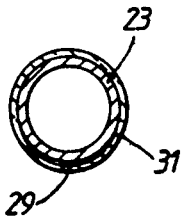
FIG. 2 is a sectional side view taken on line II—II of FIG. 1.

A first embodiment of the present invention will now be described with reference to FIGS. 1, 2, 3 and 4. A ring-shaped fluorescent lamp device 21 includes a circular bulb 23 made of glass, such as, e.g., a quartz glass, a hard glass, a soft glass, etc. Circular bulb 23 has opposite sealed end portions 23*a* and 23*b* facing one another at a prescribed distance apart. Circular bulb 23 also has linear portions 25*a* and 25*b* formed in the vicinity of the corresponding sealed end portions 23*a* and 23*b*. The bulb axis of one of the linear portions 25*a* coincides with that of the other linear portion 25*b*, as shown in FIG. 1. An internal electrode (not shown) is arranged in each linear portion 25*a*, 25*b* of bulb 23, and a lead wire 27 connected to the internal electrode is led out from sealed end portions 23*a*, 23*b*. A flexible belt-shaped heater 29 is adhered on the outer surface of bulb 23 along the bulb axis direction. The outer surface of bulb 23 and belt-shaped heater 29 are covered with a transparent heat shrinkable tube 31 to support heater 29, as shown in FIG. 2. However, a portion of bulb 23 in the vicinity of each sealed end portion 23*a*, 23*b* is not covered with heat shrinkable tube 31. A base structure 33 is arranged between opposite sealed end portions 23*a* and 23*b* and is movably and rotatably supported by linear portions 25*a* and 25*b*.

Figure 3:
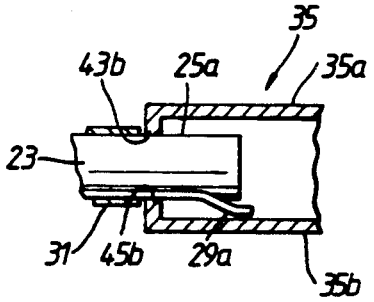
FIG. 3 is a sectional segmentary view illustrating the connecting portion of the bulb and the base structure of the lamp device shown in FIG. 1.
Figure 4:
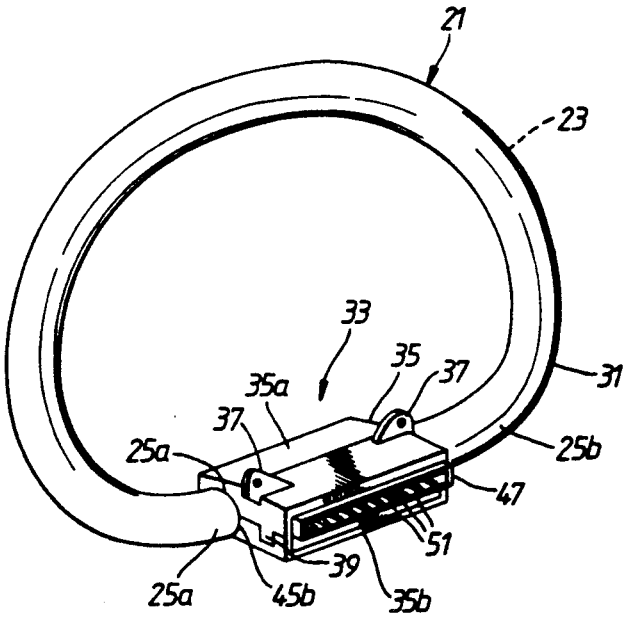
FIG. 4 is a perspective view of the ring-shaped lamp device shown in FIG. 1.

The construction of base structure 33 will be described in more detail. Base structure 33 includes a box-shaped flat connector cover 35 made of an insulation material, e.g., synthetic resin, by molding. Connector cover 35 is composed of a first or upper cover element 35*a* and a second or lower cover element 36*b*. A pair of brackets 37 project from the upper surface of upper cover element 35a. A hole 37a is formed in each bracket 37 to fix or mount lamp device 21 to a separate supporter (not shown) by a screw (not shown) therethrough. A plurality of engaging pawls 39 extend downward from the lower edge of upper cover element 35a. A plurality of depressions 41 are formed on the outer peripheral wall of lower cover element 35b corresponding to the plurality of engaging pawls 39 to integrate upper cover element 35a and lower cover element 35b by the engagement of engaging pawls 39 and depressions 41. These pawls and depressions and associated structure comprise the means for connecting the first and second cover elements together. A pair of arc-shaped recesses 43a, 43b are formed in opposite edge surfaces of upper cover element 35a facing to the circumferential surface of bulb 23. A pair of arc-shaped recesses 45a, 45b also are formed in opposite edge surfaces of lower cover element 35b to form a lamp supporting section together with the pair of arc-shaped recesses 43a, 43b of upper cover element 35a. Thus, linear portions 25a and 25b exposed from heat shrinkable tube 31 in the vicinity of the corresponding sealed end portions 23a and 23b of bulb 23 are movably and rotatably supported by the lamp supporting section after upper cover element 35a is engaged with lower cover element 35b, as shown in FIGS. 3 and 4. Base structure 33 and bulb 23 are relatively rotatable around the bulb axis.

As shown in FIG. 4, a connecting recess 47 is formed when upper and lower cover elements 35a and 35b are integrated. FIG. 1 illustrates connector 49 having a plurality of connecting pins 51 therein is arranged in connecting recess 47. A printed circuit board 53 is vertically arranged opposite to connector 49 in base structure 33 to connect lead wires 27 from bulb 23, and lead wires 29a from heater 29 with a plurality of wiring pins 55 corresponding to the plurality of connecting pins 51 therethrough. Thus, an external power voltage (not shown) is supplied to the internal electrodes of bulb 23 and heater 29 through the plurality of connecting pins 51 of connector 49.

A plurality of projections 57 perpendicularly extend from the surface of lower cover element 35b to arrange a plurality of internal lead wirings (not shown) extending between connector 49 and printed circuit board 53.

With the above-described embodiment, since bulb 23 and base structure 33 rotate relative to one another within a given range, the location of bulb 23 may be adjusted with respect to the position in which a meter of an automobile, e.g., a speedometer, is supported. Thus, lamp device 21 is assembled so that it may be adjusted to suitably light the meter from behind. Furthermore, when the adjustment of the position of bulb 23 is required after base structure 33 has been fixed to the external supporting device (not shown) through the pair of brackets 37 bulb 23 may be rotated within a given range against base structure 33. Bulb 23 and base structure 33 may be fixed to one another by a bonding agent after the adjustment of bulb 23 is accomplished.

Figure 5:
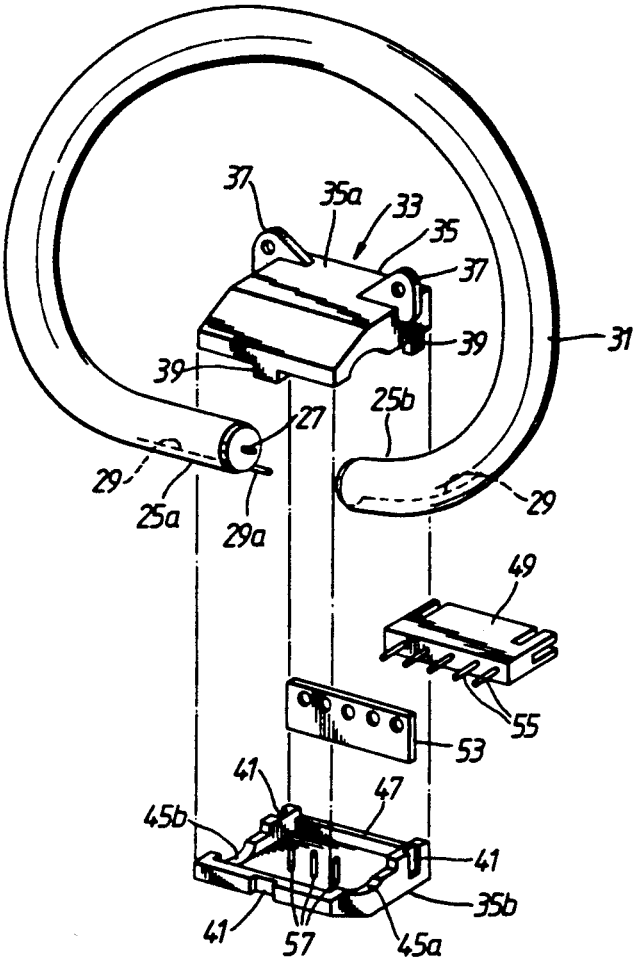
FIG. 5 is an exploded perspective view illustrating a ring-shaped lamp device of a second embodiment of the present invention.
Figure 6:
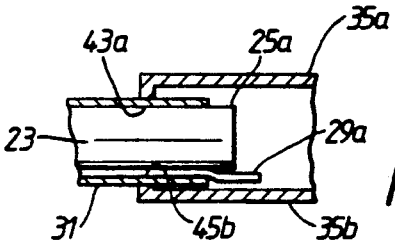
FIG. 6 is a sectional segmentary view illustrating the connecting portion of the bulb and the base structure of the lamp device shown in FIG. 5.

A second embodiment will be described hereafter. In the above-described embodiment, upper and lower cover elements 35a and 35b were integrated such that they straddled between linear portions 25a and 25b of bulb 23 exposed from heat shrinkable tube 31 in the vicinity of the corresponding sealed end portions 23a and 23b. However, in the second embodiment shown in FIGS. 5 and 6, the entire surface of bulb 23 may be covered with heat shrinkable tube 31. Upper and lower cover elements 35a and 35b may also be attached to linear portions 25a and 25b in the vicinity of the corresponding sealed end portions 23a and 23b of bulb 23 through heat shrinkable tube 31. Thus, base structure 33 is stably engaged with bulb 23. However, bulb 23 may be rotated against base structure 33 when a relatively strong rotating force is applied to bulb 23 and the friction between heat shrinkable tube 31 and base structure 33 is overcome. Thereafter, the adjusted position will be maintained because of the friction of heat shrinkable tube 31 sandwiched between base structure 33 and bulb 23.

Figure 7:
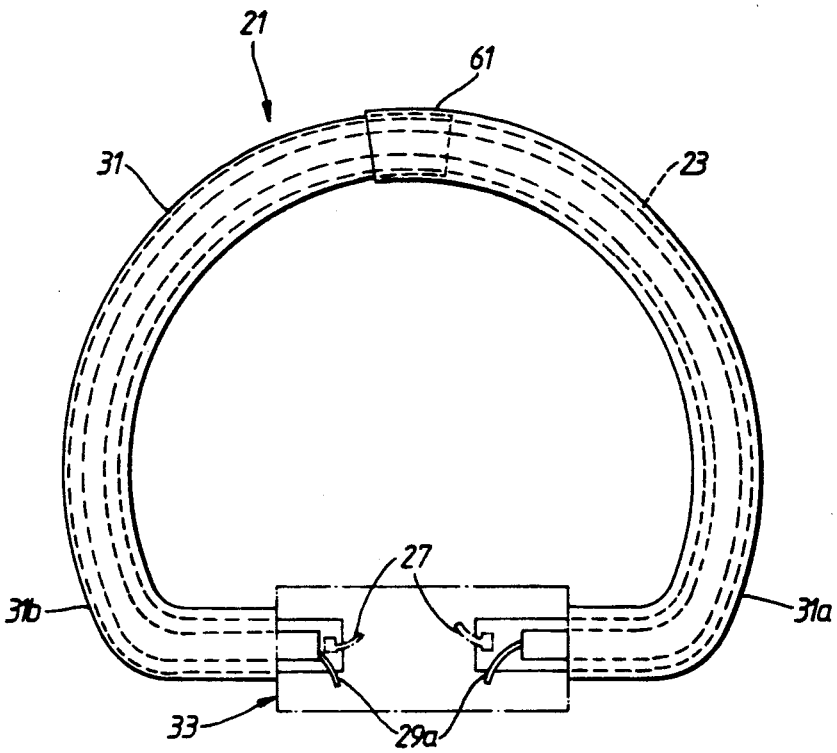
FIG. 7 is a schematic front view illustrating a ring-shaped lamp device of a third embodiment of the present invention.

A third embodiment will be described hereafter. A heat shrinkable tube 31 into which ring-shaped bulb 23 is inserted may be divided into at least two pieces 31a and 31b, as shown in FIG. 7. Since the length of pieces 31a and 31b are short, as compared with that of tube 31 of the first embodiment, ring-shaped bulb 23 is easily inserted into pieces 31a and 31b with a reduced resistance between bulb 23 and each heat shrinkable tube piece 31a, 31b. Furthermore, since one end of each heat shrinkable tube piece 31a, 31b is overlapped with the other in the middle portion of bulb 23, the overlap portion 61 shown in FIG. 7 serves as a margin of the heat shrinkage when each heat shrinkable tube piece 31a, 31b is heated from the other end thereof. Thus, the entire outer surface of ring-shaped bulb 23 can be covered with heat shrinkable tube piece 31a, 31b without exposing the outer surface thereof. Also, since the length of heat shrinkable tube pieces 31a and 31b are short, air existing between the outer surface of bulb 23 and heat shrinkable tube pieces 31a and 31b is easily exhausted when each tube piece 31a, 31b is heated, resulting in uniform adherence of each tube piece 31a, 31b to the outer surface of bulb 23.

The present invention has been described with respect to specific embodiments. However, other embodiments based on the principles of the present invention should occur to those of ordinary skill in the art. Such embodiments are intended to be covered by the claims.

What is claimed is:

1. A ring-shaped lamp device which is supported by an external supporter, comprising:

a bulb including:

a tubular ring-shaped body portion having a defined annular length, and a pair of tubular linear portions each having a defined length, a first end of each tubular linear portion being integrally connected, as one piece, to a corresponding end of the tubular ring-shaped body portion, the second end of each tubular linear portion being sealed, the second end of one tubular linear portion facing the second end of the other tubular linear portion so that the bulb axis of the one tubular linear portion coincides with that of the other tubular linear portion;

a pair of electrodes, one of which is disposed in each of the tubular linear portions, for producing discharge therebetween through the tubular ring-shaped body portion;

a base structure having a connector which is adapted to be connected to the pair of electrodes, the base structure being rotatably connected around the outer surfaces of the tubular linear portions so that the lamp is rotatable with regard to the connection between the base structure and each outer surface of the tubular linear portions; and two heat shrinkable tubular pieces which cover the ring-shaped body and the linear portions, one end of each tubular piece overlapping one end of the other tubular piece at the ring-shaped body overlap portion located substantially midway between the ring-shaped body portion corresponding ends.

2. A lamp device according to claim 1, wherein the base structure includes first and second cover elements each having opposed connecting means for connecting the first and second cover elements around the tubular linear portions.

3. A lamp device according to claim 2, wherein the connecting means includes a plurality of depressions formed in one of first and second cover elements and a plurality of engaging pawls formed on the other cover element, the plurality of engaging pawls engaging with the plurality of depressions.

4. A lamp device according to claim 2, wherein the first and second cover elements respectively include a pair of arc-shaped recesses for rotatably supporting the second end of each tubular linear portion of the bulb when the first and second cover elements are connected around the tubular linear portions.

5. A lamp device according to claim 2, wherein the base structure includes means for mounting the lamp device to the external supporter.

6. A ring-shaped lamp device according to claim 5, wherein the mounting means includes a pair of brackets projecting from the first cover element of the base structure.

* * * * *